US008384732B2

(12) United States Patent
Lien et al.

(10) Patent No.: US 8,384,732 B2
(45) Date of Patent: Feb. 26, 2013

(54) METHOD FOR ADJUSTING COLOR SATURATION AND IMAGE DISPLAYING SYSTEM APPLYING THE SAME

(75) Inventors: Chun-Hung Lien, Taipei (TW); Dong-Yang Lin, Taipei County (TW); Ching-Hsung Wang, Taipei County (TW)

(73) Assignee: Novatek Microelectronics Corp., Hsinchu (TW)

( * ) Notice: Subject to any disclaimer, the term of this patent is extended or adjusted under 35 U.S.C. 154(b) by 1190 days.

(21) Appl. No.: 12/210,224

(22) Filed: Sep. 15, 2008

(65) Prior Publication Data

US 2009/0315912 A1 Dec. 24, 2009

(30) Foreign Application Priority Data

Jun. 18, 2008 (TW) ..... 97122689 A

(51) Int. Cl.
*G09G 5/02* (2006.01)

(52) U.S. Cl. ..... 345/590; 345/589; 345/614; 345/617; 382/167; 382/168; 382/170

(58) Field of Classification Search ..... None
See application file for complete search history.

(56) References Cited

U.S. PATENT DOCUMENTS

| | | | | |
|---|---|---|---|---|
| 4,812,902 | A | 3/1989 | Fuchsberger | |
| 5,398,120 | A | 3/1995 | Friedman et al. | |
| 6,650,336 | B2 * | 11/2003 | Suzuki | 345/589 |
| 6,724,935 | B1 | 4/2004 | Sawada et al. | |
| 7,042,520 | B2 | 5/2006 | Kim | |
| 7,358,976 | B2 * | 4/2008 | Hampshire et al. | 345/589 |
| 7,483,082 | B2 * | 1/2009 | Chou | 348/645 |
| 2005/0047657 | A1 | 3/2005 | Lee | |
| 2005/0052666 | A1 | 3/2005 | Yamamoto | |
| 2006/0045330 | A1 | 3/2006 | Marion | |

FOREIGN PATENT DOCUMENTS

| | | |
|---|---|---|
| TW | 200726271 | 7/2007 |
| TW | 200735671 | 9/2007 |

OTHER PUBLICATIONS

"Office Action of Taiwan Counterpart Application", issued on Mar. 26, 2012, p. 1-p. 4.

* cited by examiner

*Primary Examiner* — Antonio A Caschera
(74) *Attorney, Agent, or Firm* — Jianq Chyun IP Office

(57) ABSTRACT

A method for adjusting color saturation is adapted for color adjustment of a pixel in a color space. The method includes: determining a color cube in the color space; selecting one from a plurality of diagonals of the color cube as a primary diagonal, and setting the primary diagonal at a vertical axis of the color space; determining a hue azimuth angle and a height in the color cube desired by the pixel; determining a reference point at an outermost periphery of the color cube corresponding to the azimuth angle, and obtaining a reference height and a reference horizontal distance of the reference point distant from the primary diagonal; and obtaining a color saturation value of the pixel by multiplying the reference horizontal distance with a ratio between the reference height and the height of the pixel.

16 Claims, 5 Drawing Sheets

METHOD FOR ADJUSTING COLOR SATURATION AND IMAGE DISPLAYING SYSTEM APPLYING THE SAME

CROSS-REFERENCE TO RELATED APPLICATION

This application claims the priority benefit of Taiwan application serial no. 97122689, filed on Jun. 18, 2008. The entirety of the above-mentioned patent application is hereby incorporated by reference herein and made a part of specification.

BACKGROUND OF THE INVENTION

1. Field of the Invention

The present invention generally relates to a color adjusting technology for images, and more particularly, to a method for adjusting color saturation.

2. Description of Related Art

For the purpose of making images to be displayed, e.g., television images looked more vivid, a user may adjust the images according to user's preference. Hue and saturation are two common parameters used for adjustment. When an RGB color space is converted into a YUV color space, a pixel is defined with coordinate, p(y, u, v). The pixel saturation (sat) is a vector length at a UV plane, i.e., $sat=\sqrt{u^2+v^2}$. Therefore, adjustment to the pixel saturation is to adjust values of the original pixels, $sat=\sqrt{u^2+v^2}$.

FIG. 1 is a schematic diagram illustrating a relationship of corresponding colors in a YUV color space. Referring to FIG. 1, color data of pixels are usually achieved in a RGB manner, and described in the YUV color space after being spatially converted. The YUV color space includes three axes, Y-axis, U-axis, and V-axis. The Y-axis is a vertical axis corresponding to brightness, while the U-axis and V-axis constitute a hue horizontal plane. When converted from an RGB space to a YUV space, an RGB color cube is also converted to a YUV color cube 100. A primary diagonal connecting a black point and white point is parallel with the Y-axis. However, the black point of the color cube is a translation from although not positioned at an origin of the YUV space. Therefore, when performing a geometry analysis, the coordinates can be simply moved to the primary diagonal, which is convenient for analysing and adjusting.

FIG. 2 is a schematic diagram illustrating a hue-saturation relationship in a YUV color space. Referring to FIG. 2, the primary diagonal of the YUV color cube 100 is constituted by connecting a black point 102 with a white point 104. For convenience of analysis, the primary diagonal can be moved to the Y-axis. A pixel 108 is described as p(y, u, v) in the color cube 100. In a normal color displaying condition, the pixel 108 is positioned inside the color cube 100. When the pixel 108 is positioned outside a boundary of the color cube 100, a color oversaturation occurs which causes unnatural color displaying.

In other words, in a horizontal plane 106 with a fixed y value, when adjusting the color saturation $\sqrt{u^2+v^2}$, the $sat=\sqrt{u^2+v^2}$ is usually desired to be adjusted within the boundary. A region 106*a* having an irregular boundary is achieved by cutting the color cube 100 with the horizontal plane 106, i.e., the region at the UV plane as shown in FIG. 2. A radial coordinate $rs=\sqrt{u^2+v^2}$ of the pixel 108 is also called the saturation (sat). The direction angle θ defined by the coordinates u and v, describes the color hue.

FIG. 3 illustrates problems when adjusting the color saturation of the pixels. Referring to FIG. 3, because region 106*a* achieved by cutting the color cube 100 with the horizontal plane 106 irregularly varies, the boundary thereof thus varies according to variation of the height thereof, i.e., y value. Although the boundary can be obtained by geometry analysis, the geometry analysis requires for complicated computation. As such, when the pixel 108 is adjusted to a position p'(y', u', v') of a pixel 110, the pixel 108 may exceed the boundary for a distance Doff, which causes color oversaturation. In other words, when adjusting colors, the boundary estimation must be considered. However, how to conveniently obtain the boundary positions is an important concern.

SUMMARY OF THE INVENTION

Accordingly, the present invention is directed to provide a method for adjusting color saturation, adapted for obtaining a cutting boundary of a color cube and providing convenience for color saturation adjustment.

The present invention is also directed to a color image displaying system, applying color saturation adjusting method for adjusting colors.

The present invention provides a method for adjusting color saturation, adapted for color adjustment of a pixel in a color space. The method includes: determining a color cube in the color space; selecting one from a plurality of diagonals of the color cube as a primary diagonal, and setting the primary diagonal at a vertical axis of the color space; determining a hue azimuth angle and a height in the color cube desired by the pixel; determining a reference point at an outermost periphery of the color cube corresponding to the azimuth angle, and obtaining a reference height and a reference horizontal distance of the reference point distant from the primary diagonal; and obtaining a color saturation value of the pixel by multiplying the reference horizontal distance with a ratio between the reference height and the height of the pixel.

The present invention further provides a method for adjusting color saturation, adapted for color adjustment of a pixel in a color space. The method includes: determining a color cube in the color space; selecting one from a plurality of diagonals of the color cube as a primary diagonal, and setting the primary diagonal as at a vertical axis of the color space; determining a hue azimuth angle and a height in the color cube of the pixel; selecting N reference points at an outermost periphery of the color cube corresponding to a reference azimuth angle; calculating each of the reference points and obtaining a reference height and a reference horizontal distance distant from the primary diagonal, thus obtaining an angle data list and recording the angle data list in a storage device; obtaining an estimated horizontal distance and an estimated height corresponding to the hue azimuth angle of the pixel, according to the angle data list; and obtaining a color saturation value of the pixel by multiplying the estimated horizontal distance with a ratio between the estimated height and the height of the pixel.

The present invention further provides an image displaying system, including a signal processing unit, a color adjusting unit, and a displaying unit. The signal processing unit processes a received image signal and obtains a pixel color data of each pixel of an image. The color adjusting unit executes a color saturation adjustment to the pixel color data, in which the color adjusting unit includes a circuit for applying the foregoing method for adjusting color saturation. The displaying unit displays according to the pixel after the adjustment.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
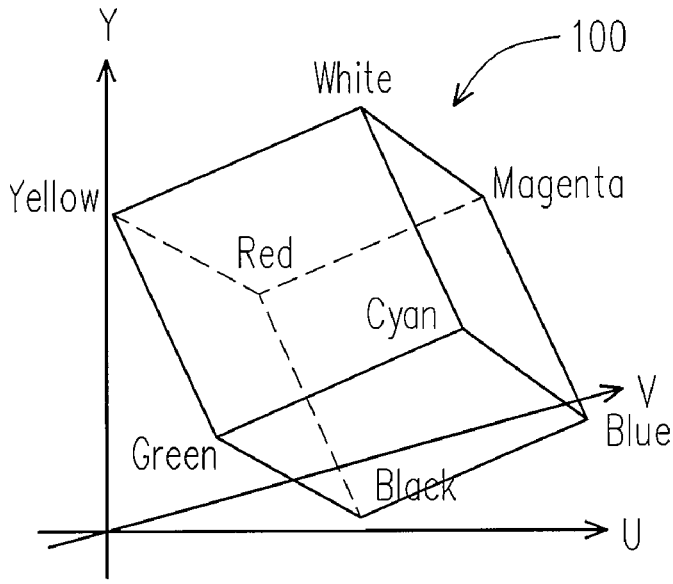
FIG. 1 (PRIOR ART)
FIG. 1 is a schematic diagram illustrating a relationship of corresponding colors in a YUV color space.
Figure 2:
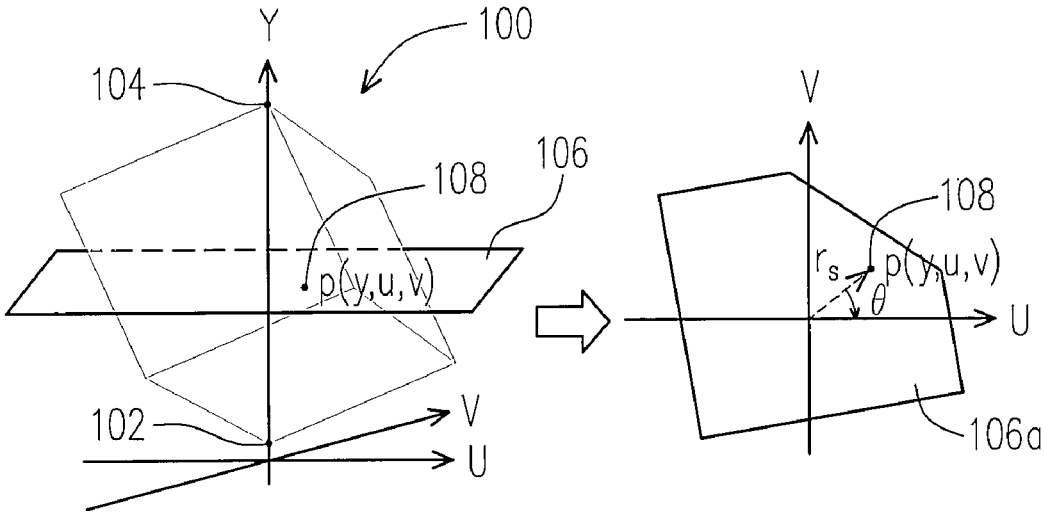
FIG. 2 (PRIOR ART)
FIG. 2 is a schematic diagram illustrating a hue-saturation relationship in a YUV color space.
Figure 3:
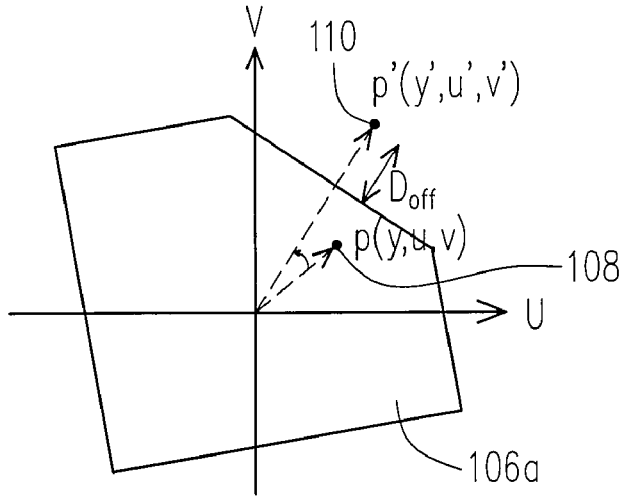
FIG. 3 (PRIOR ART)
FIG. 3 illustrates problems when adjusting the color saturation of the pixels.

Reference will now be made in detail to the present preferred embodiments of the invention, examples of which are illustrated in the accompanying drawings. Wherever possible, the same reference counting numbers are used in the drawings and the description to refer to the same or like parts.

The present invention provides a method for adjusting color saturation. The present invention obtains a boundary of a color cube by referring to data of reference points, which is helpful for adjusting the pixel color. Embodiments will be given below for illustration purpose only without restricting the scope of the present invention.

Figure 4:
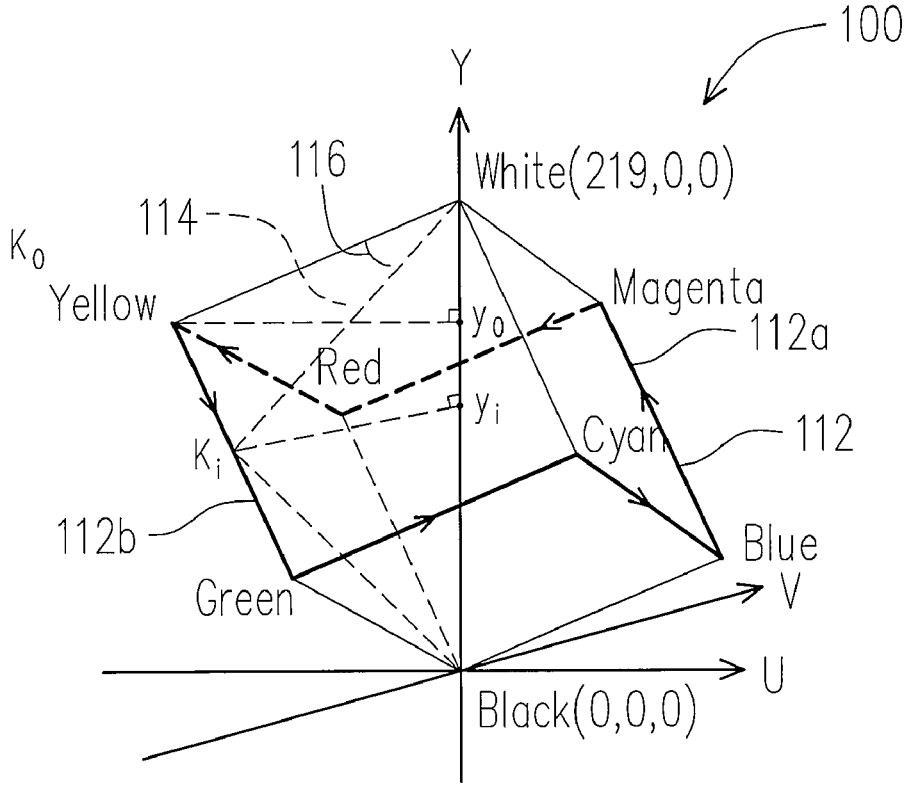
FIG. 4 illustrates a mechanism of calculating a boundary of the cube according to an embodiment of the present invention.

FIG. 4 illustrates a mechanism of calculating a boundary of the cube according to an embodiment of the present invention. Referring to FIG. 4, the current embodiment illustrates how to effectively obtain positions of the boundary of the color cube, taking a YUV color space as an example. However, it should be noted that the present invention can also be applied in other operations which require the boundary data of the color cube. In other words, the present invention can also applied to other color spaces in cube, such as YCbCr cube, YIQ cube or other cube. The present invention can also be further applied in adjusting other applicable parameters, and should not be restricted as only for adjusting the color saturation parameters. In other words, the YUV coordinate axes can be coordinate axes representing other physical quantities and should not be restricted as for application of color adjusting only. Color is only one of the physical quantities which can be represented by the coordinate axes and adjusted by the method.

For convenience of operation, the primary diagonal of the color cube 100 is set at the vertical axis, i.e., Y-axis of the coordinate axes. Namely, the black point of the color cube 100 is positioned at (0, 0, 0), and the white point is positioned at (219, 0, 0), in which it is supposed that the brightness grey level distribution between the black point and the white point is variable from 0 to 219 on the Y-axis.

An outermost periphery 112 of the cube 100 is constituted of six consecutive laterals of the cube 100, in which three consecutive laterals constitute a semi-periphery 112*a*, and another three consecutive laterals constitute another semi-periphery 112*b*. The two semi-peripheries 112*a* and 112*b* are symmetric to each other. For example, a coordinate of point $K_0$ of Yellow at Y-axis is y0. For effectively describing points of the cube 100 at other planes, a point Ki is selected from the outermost periphery 112. The point Ki has an azimuth angle 116 at the U plane. Such an azimuth angle 116 is descriptive only hereby, and is determined by a reference 0°, and clockwise or anticlockwise variation. For example, atan (v/u) determines the range from 0 to π, and the range from π to 2π can be obtained by symmetrical angles.

Point Ki is positioned at yi of Y-axis. A triangle 114 defined by the black point, point Ki, and the white point can describe any point of the cube 100 in this azimuth angle. In other words, a segment connecting the point Ki and the black point describes one plane of the cube 100, and a segment connecting the point Ki and the white point describes another one plane of the cube 100. When the point Ki moves along the outermost periphery 112, the hue azimuth angle correspondingly varies between 0 to 2π.

Further, a boundary of a region 106*a* cut by a plane having a yi coordinate at Y-axis is the saturation, which can be learnt by calculating with different points Ki. As such, with respect to the yi plane, positions of points Ki can also be correspondingly obtained from the hue azimuth angles between 0 to 2π.

Figure 5A:
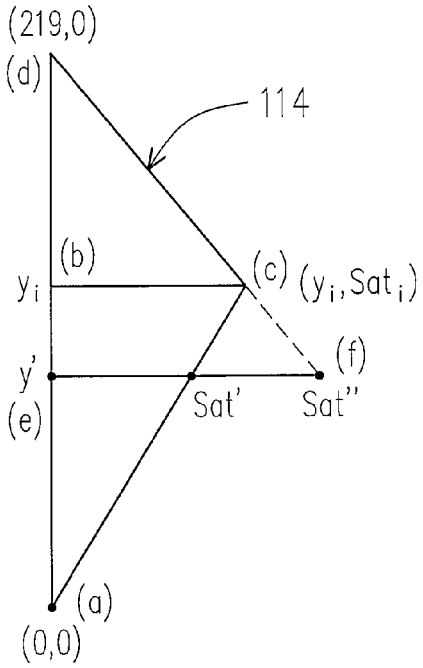
FIGS. 5A through 5B are schematic diagrams illustrating the mechanism for obtaining the boundary according to an embodiment of the present invention.
Figure 5B:
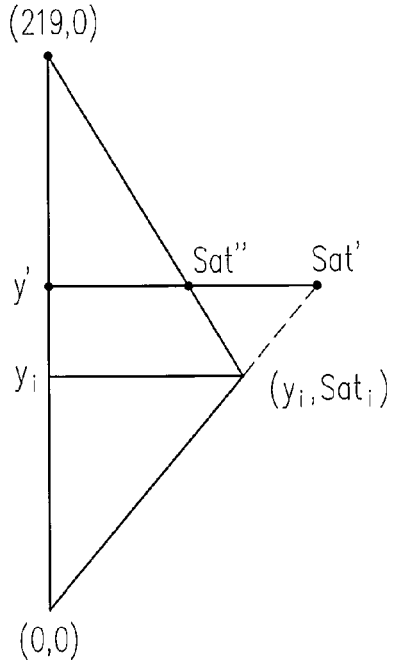

Further, it is to be further described below how to calculate the saturation, i.e., boundary, of the Y=yi plane by the triangle 114. FIGS. 5A through 5B are schematic diagrams illustrating the mechanism for obtaining the boundary according to an embodiment of the present invention. Referring to FIG. 5A, and taking the triangle 114 of FIG. 4 as an example, point Ki is ($y_i$, $Sat_i$), in which $Sat_i=\sqrt{u^2+v^2}$, representing the saturation. A vertical side of the triangle 114 is at the Y-axis, and two oblique sides are positioned at two planes of the cube 100, respectively, for example a plane defined by four points of white, yellow, green, and cyan, and a plane defined by four points of red, yellow, green, and black. When a y coordinate of a pixel to be adjusted is y', and y'<yi, Sat' and Sat" values can be calculated by configuring a triangle with points (a), (b), (c), and another triangle with points (d), (b), (c), according to a proportional relationship between homothetic triangles, in which $$Sat' = y' \cdot \frac{Sat_1}{y_i} \tag{1}$$

$$Sat'' = (219 - y') \cdot \frac{Sat_1}{219 - y_i}, \tag{2}$$

in which Sat' is a correct value at the oblique sides. The Sat' and Sat" are calculated for the convenience of operation by looking up a table. FIG. 5 describes a situation of y'<yi, in which Sat' can be obtained according to equation (1), while the Sat" obtained according to equation (2) is incorrect. Referring to FIG. 5B, when y'>yi, the Sat' obtained according to equation (1) is incorrect, while the Sat" obtained according to equation (2) is correct. In a particular situation of y'=yi, equation (1) is identical to equation (2), and then anyone one of equation (1) and equation (2) can be taken. As such, according to the foregoing, it can be learnt that the smaller one of the Sat' and Sat" is correct, so that the calculation can be simplified by looking up table, and the correct value can be conveniently determined. Further, FIGS. 5A and 5B illustrate an embodiment only. Generally, a correct saturation on the oblique sides can be obtained according to a ratio between y' and yi.

According to the foregoing mechanism, a data list is prepared, for example by selecting n points at the outermost periphery 112. Specifically, for example, the n points are n equally distributional points from 0 to 2π, or equidistantly distributed n points at the outermost periphery, in which n can be selected in accordance with the desired accuracy. Further, because of the symmetrical relationship between the outermost periphery 112*a* and the outermost periphery 112*b*, it is sufficient to record reference points of either the outermost periphery 112*a* or the outermost periphery 112*b* only. A saturation $Sat_1$ is calculated with respect to each of the reference points, and the data list is recorded by a storage unit, such as table 1 or table 2. Table 1 is a data list of n reference points equidistantly distributed between 0 to 2π, and Table 2 is a simplified data list according symmetrical relationship with respect to Table 1. Correct saturation values, i.e., distances horizontally distant from the primary diagonal, can be obtained according to equations (1) and (2).

TABLE 1

| Angle code | Sat' normal value | Sat'' normal value |
|---|---|---|
| 0 | $Sat_0/y_0$ | $Sat_0/(219 - y_0)$ |
| 1 | $Sat_1/y_1$ | $Sat_1/(219 - y_1)$ |
| . | . | . |
| . | . | . |
| . | . | . |
| N | $Sat_n/y_n$ | $Sat_n/(219 - y_n)$ |

TABLE 2

| Angle code | Sat' normal value | Sat'' normal value |
|---|---|---|
| 0 | $Sat_0/y_0$ | $Sat_0/(219 - y_0)$ |
| 1 | $Sat_1/y_1$ | $Sat_1/(219 - y_1)$ |
| . | . | . |
| . | . | . |
| . | . | . |
| n/2 − 1 | $Sat_{n/2-1}/y_n$ | $Sat_{n/2-1}/(219 - y_{n/2-1})$ |

Figure 6:
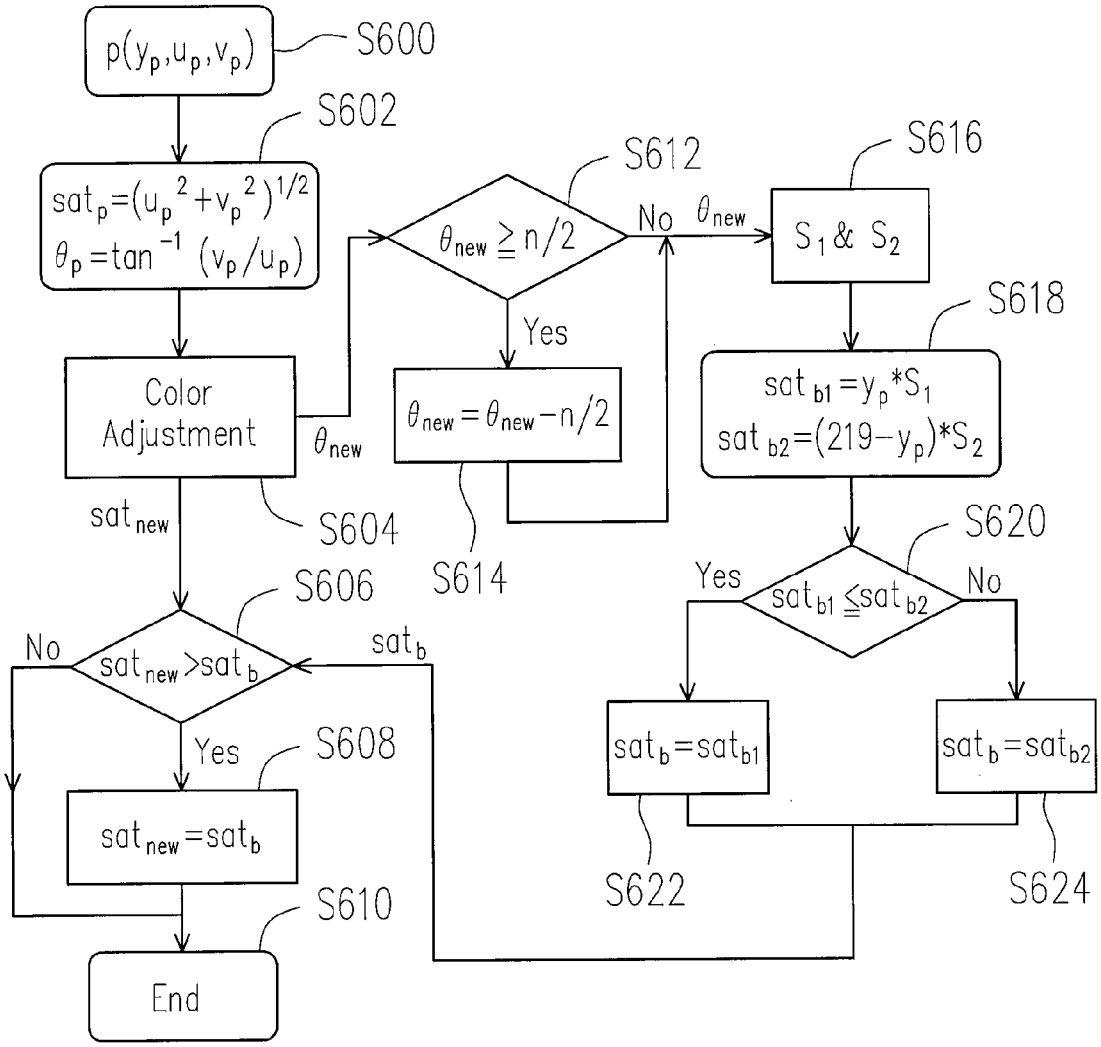
FIG. 6 is a flow chart illustrating a method of obtaining an adjusted saturation $Sat_{new}$ according to an embodiment of the present invention.

FIG. 6 is a flow chart illustrating a method of obtaining an adjusted saturation $Sat_{new}$ according to an embodiment of the present invention. Referring to FIG. 6, step S600 determines the pixel $p(y_p, u_p, v_p)$ which is to be adjusted. Step S602 calculates the $Sat_p$ and the hue azimuth angle $\theta_p$. Step S604 executes a color adjustment to obtain an estimated saturation to be adjusted to $Sat_{new}$, and an estimated hue azimuth angle to be adjusted to $\theta_{new}$. Before practically adjusting the saturation $Sat_{new}$, the saturation $Sat_{new}$ should be ensured as not exceeding the boundary, which causes an oversaturation.

Taking the mechanism of Table 2 as an example, step S612 determines whether $\theta_{new}$ belongs to a range of Table 2 between 0 to π. If $\theta_{new} \geqq n/2$, then step S614 adjusts $\theta_{new}$ to be $\theta_{new} - n/2$. Step S616 looks up the table and obtains two saturation normal values S1 (Sat') and S2 (Sat''). Step S618 calculates $Sat_{b1}$ and $Sat_{b2}$, according to equations (1) and (2). Steps 620 through 624 select a smaller one of $Sat_{b1}$ and $Sat_{b2}$ as the $Sat_b$. In other words, when $Sat_{b1} \leqq Sat_{b2}$, then $Sat_b = Sat_{b1}$, and when $Sat_{b1} > Sat_{b2}$, then $Sat_b = Sat_{b2}$. Step S606 determines whether $Sat_{new}$ is greater than the boundary saturation $Sat_b$ or not. At step S608, if $Sat_{new}$ is greater than the boundary saturation $Sat_b$, then $Sat_{new}$ is set as equal to $Sat_b$. At step S610, when the step S608 finishes or $Sat_{new}$ is new not greater than $Sat_b$ in step S606, the process goes to an end.

The foregoing steps illustrate a flow of the method of an embodiment. The present invention is not restricted by the foregoing embodiment. If the data of the data list is different, the calculation method would also vary. As to the look-up table mechanism, it can be realized by interpolation, for obtaining a more accurate $Sat_b$.

Figure 7:
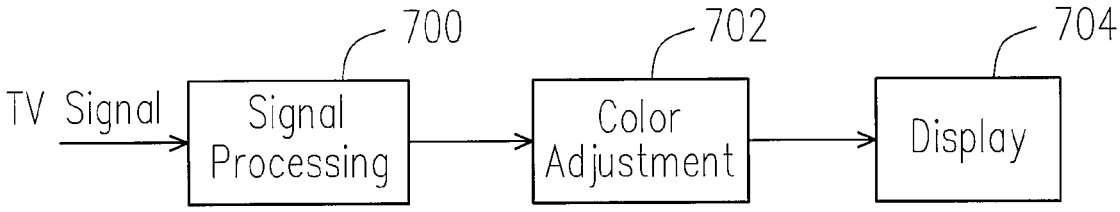
FIG. 7 is a systematic block diagram illustrating the system applying the method for adjusting color saturation, according to an embodiment of the present invention.

FIG. 7 is a systematic block diagram illustrating the system applying the method for adjusting color saturation, according to an embodiment of the present invention. Referring to FIG. 7, it illustrates an image displaying system. The image displaying system for example includes a signal processing unit 700, a color adjusting unit 702, and a displaying unit 704. The signal processing unit 700 processes a received image signal (TV signal), and obtains a pixel color data of each pixel of an image. The color adjusting unit 702 executes a color saturation adjustment to the pixel color data, in which the color adjusting unit 702 includes a circuit for applying the foregoing method for adjusting color saturation. The displaying unit 704 displays according to the pixel after the adjustment. The color adjusting unit of the present invention is featured in simplified calculation and having no oversaturation of color adjustment. As such, the present invention provides an applicable solution for systems which need to continuously receive image signals, such as television systems.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for adjusting color saturation, implemented in an image display system performed by circuit units for color adjustment of a pixel in a color space, the method comprising:

determining a color cube in the color space by at least one circuit unit of the image display system;

selecting one from a plurality of diagonals of the color cube as a primary diagonal, and setting the primary diagonal at a vertical axis of the color space by the circuit unit of the image display system;

determining a hue azimuth angle and a height in the color cube of the pixel by the circuit unit of the image display system;

determining a reference point at an outermost periphery of the color cube corresponding to the azimuth angle, and obtaining a reference height and a reference horizontal distance of the reference point distant from the primary diagonal by the circuit unit of the image display system; and obtaining a color saturation value of the pixel by multiplying the reference horizontal distance with a ratio between the reference height and the height of the pixel by the circuit unit of the image display system.

2. The method for adjusting color saturation according to claim 1, wherein the step of obtaining the color saturation value of the pixel comprises:

obtaining a first height and a second height of the pixel in the color cube, wherein the first height and the second height are two distances of the pixel distant from a first end and a second end of the primary diagonal, respectively;

calculating a first saturation parameter and a second saturation parameter, wherein the first saturation parameter=the first height×the reference horizontal distance/the reference height; and the second saturation parameter=the second height×the reference horizontal distance/(a length of the primary diagonal−the reference height); and selecting a smaller one of the first saturation parameter and the second saturation parameter as the color saturation value of the pixel.

3. The method for adjusting color saturation according to claim 1, wherein the color space is a coordinate space of YUV, YCbCr, or YIQ; the primary diagonal of the color cube is positioned at a Y-axis of the coordinate space; and when coordinates of the pixel are described as p(y, u, v), y represents the height, and atan (v/u) represents the hue azimuth angle.

4. The method for adjusting color saturation according to claim 1, wherein the primary diagonal of the color cube is a diagonal connecting a black point and a white point.

5. The method for adjusting color saturation according to claim 1, wherein the color space is obtained by converting an RGB coordinate space into a coordinate space of YUV, YCbCr, or YIQ.

6. The method for adjusting color saturation according to claim 1, wherein the outermost periphery of the color cube is constituted by six consecutive outermost sides of the color cube.

7. The method for adjusting color saturation according to claim 1, wherein pixel is one of a plurality of pixels of an image signal.

8. The method for adjusting color saturation according to claim 7, wherein the image signal is a television image signal.

9. An image displaying system, comprising:

a signal processing unit, processing a received image signal and obtaining a pixel color data of each pixel of an image;

a color adjusting unit, executing a color saturation adjustment to the pixel color data, wherein the color adjusting unit comprises a circuit for applying a method for adjusting color saturation; and a displaying unit for displaying according to the pixel after the adjustment, wherein the method applied by the circuit comprising:

determining a color cube in the color space;

selecting one from a plurality of diagonals of the color cube as a primary diagonal, and setting the primary diagonal at a vertical axis of the color space;

determining a hue azimuth angle and a height in the color cube of the pixel;

determining a reference point at an outermost periphery of the color cube corresponding to the azimuth angle, and obtaining a reference height and a reference horizontal distance of the reference point distant from the primary diagonal; and obtaining a color saturation value of the pixel by multiplying the reference horizontal distance with a ratio between the reference height and the height of the pixel.

10. The image displaying system according to claim 9, wherein the processing step of obtaining the color saturation value of the pixel comprises:

obtaining a first height and a second height of the pixel in the color cube, wherein the first height and the second height are two distances of the pixel distant from a first end and a second end of the primary diagonal, respectively;

calculating a first saturation parameter and a second saturation parameter, wherein the first saturation parameter=the first height×the reference horizontal distance/the reference height; and the second saturation parameter=the second height×the reference horizontal distance/(a length of the primary diagonal−the reference height); and selecting a smaller one of the first saturation parameter and the second saturation parameter serving as the color saturation value of the pixel.

11. The image displaying system according to claim 9, wherein the color space is a coordinate space of YUV, YCbCr, or YIQ; the primary diagonal of the color cube is positioned at a Y-axis of the YUV coordinate space; and when coordinates of the pixel are described as p(y, u, v), y represents the height, and atan (v/u) represents the hue azimuth angle.

12. The image displaying system according to claim 9, wherein the primary diagonal of the color cube is a diagonal connecting a black point and a white point.

13. The image displaying system according to claim 9, wherein the color space is obtained by converting an RGB coordinate space into a coordinate space of YUV, YCbCr, or YIQ.

14. The image displaying system according to claim 9, wherein the outermost periphery of the color cube is constituted by six consecutive outermost sides of the color cube.

15. The image displaying system according to claim 9, wherein pixel is one of a plurality of pixels of an image signal.

16. The image displaying system according to claim 15, wherein the image signal is a television image signal.

* * * * *